US005810430A

United States Patent [19]

Bryjak et al.

[11] Patent Number: 5,810,430

[45] Date of Patent: Sep. 22, 1998

[54] PORTABLE SEATING APPARATUS

[75] Inventors: John Jack Bryjak, Park Ridge; Arthur Hergott, Deerfield; Troy W. Livingston, Northbrook, all of Ill.

[73] Assignee: Greenwhich Industries, L.P., Lake Bluff, Ill.

[21] Appl. No.: 797,030

[22] Filed: Feb. 7, 1997

[51] Int. Cl.[6] ..... A47C 4/00

[52] U.S. Cl. ..... 297/17; 297/139; 297/233; 297/236; 297/234; 297/241

[58] Field of Search ..... 297/17, 232, 233, 297/234, 236, 241, 139

[56] References Cited

U.S. PATENT DOCUMENTS

| | | | |
|---|---|---|---|
| Re. 34,468 | 12/1993 | Rau et al. | 296/26 |
| 890,705 | 6/1908 | Pilia et al. . | |
| 1,044,160 | 11/1912 | Freedman . | |
| 1,046,055 | 12/1912 | Di Orio | 297/17 |
| 1,248,702 | 12/1917 | Percival . | |
| 1,282,220 | 10/1918 | Grondal | 297/236 X |
| 1,583,264 | 5/1926 | Turner, Jr. . | |
| 1,856,449 | 5/1932 | Young . | |
| 2,007,988 | 7/1935 | Thomas | 5/12 |
| 2,061,235 | 11/1936 | Horn | 20/0.5 |
| 2,121,456 | 6/1938 | Tornquist | 155/117 |
| 2,147,564 | 2/1939 | Vance | 20/0.5 |
| 2,205,624 | 6/1940 | Horn | 189/1 |
| 2,595,038 | 4/1952 | Woller | 5/29 |
| 2,738,519 | 3/1956 | Thomas | 5/12 |
| 2,755,486 | 7/1956 | Thomas | 5/12 |
| 2,815,541 | 12/1957 | Lappin et al. | 20/1.126 |
| 2,832,082 | 4/1958 | Thomas | 5/13 |
| 2,846,738 | 8/1958 | Walworth et al. | 20/1.126 |
| 2,891,255 | 6/1959 | Simmons | 5/9 |
| 2,983,968 | 5/1961 | Wurn | 20/1.126 |
| 3,482,270 | 12/1969 | Hill | 5/13 |
| 3,600,033 | 8/1971 | Holdampf et al. | 297/16 |
| 4,223,945 | 9/1980 | Nikitits | 297/139 X |
| 4,378,609 | 4/1983 | Patterson et al. | 5/12 R |
| 4,742,900 | 5/1988 | Boxhammer | 297/17 X |
| 4,979,340 | 12/1990 | Wilson et al. | 52/9 |
| 4,986,591 | 1/1991 | Martienssen et al. | 296/65.1 |
| 5,421,131 | 6/1995 | Heckman et al. | 52/263 |

FOREIGN PATENT DOCUMENTS

| | | | |
|---|---|---|---|
| 1130123 | 5/1962 | Germany | 297/233 |

*Primary Examiner*—Peter M. Cuomo
*Assistant Examiner*—Rodney B. White
*Attorney, Agent, or Firm*—Fitch, Even, Tabin & Flannery

[57] ABSTRACT

There is provided a portable seating apparatus having multiple seating tiers and an understructure system that operates to extend the seating for use and to retract the seating for storage and transport. In the storage arrangement, the lower seating and understructure is capable of being substantially retracted into a portable housing. The housing is fitted with a system of rollers that operate between an extended condition to support the housing for transport and to a retracted position to lower the housing onto stationary foot pads for use by spectators. The seating apparatus is also provided with an anti-tipping mechanism which operates to limit tipping movement of the housing during use by spectators.

20 Claims, 8 Drawing Sheets

PORTABLE SEATING APPARATUS

FIELD OF THE INVENTION

The present invention relates generally to a new and useful improvement in multiple person seating structures and, more particularly, to a compact seating structure designed to reduce space consumption and enhance portability.

BACKGROUND OF THE INVENTION

In spectating situations, such as gymnasiums, stadiums, auditoriums, schools, churches and the like, areas are set with structures or arrangements for spectator seating. In the past, seating options have focused primarily on permanent and/or large multi-tier type structures and portable chair arrangements. When the amount of dedicated seating space and common budget issues are not a concern, these options have been acceptable.

In many instances, however, the amount of space dedicated for seating is a major concern. In smaller venues, such as those typically found in older buildings, schools and churches, space is a valuable commodity, and hence, there is not very much space available for spectator seating, whether in the form of permanent or temporary type. For many events, it is often the case that spectators are turned away for lack of seating or are forced to be crowded together uncomfortably in inadequate seating or standing room areas.

Examples of known multi-tier type structures include those disclosed in U.S. Pat. Nos.: 2,061,235; 2,147,564; 2,205,624; 2,815,541; 2,846,738; and 2,983,968. Since each of these structures include a significant number of seating tiers, they tend to be too large for many of these smaller venues. Moreover, due to their size, these structures lack sufficient mobility to fit within the budgetary constrains of many organizations which desire highly portable seating arrangements which can be easily moved through doorways and hallways between different areas and rooms in the building.

These space and budget concerns are obviously magnified with seating structures that are permanently anchored, such as to the wall or ground. A further shortcoming concerning permanent-type structures is their permanent occupancy of this space. If the structures could be removed, this space would be available for non-spectating activities. Thus, when space and budgetary issues are important, the larger, multi-tier structures, whether temporary or permanent, are often undesirable.

Even though chairs, such as folding chairs, provide the benefit of being portable, they cannot always provide adequate seating. Chair arrangements commonly consume more space than multi-tier type arrangements to seat the same number of spectators. Further, since chairs are typically placed on the same floor level, the view of spectators in subsequent rows tends to be obstructive, especially with events occurring at the seating level. An even further shortcoming is that chair arrangements tend to be time consuming and labor intensive because each chair must be individually unfolded for use and folded for storage.

Overall, there is a desire for a seating structure that can accommodate a significant number of spectators in situations where there is limited seating space. There is also a desire for this seating structure to be more efficient and portable than conventional multi-tier seating and chair arrangements.

SUMMARY OF THE INVENTION

The present invention is directed to a multiple person seating apparatus that has a compact, portable storage arrangement and an effective use arrangement. The seating apparatus includes a plurality of seats in which their storage arrangement occupies a first space and their use arrangement occupies a second space. The compact storage arrangement of the first space is significantly less than the extended use arrangement of the second space.

The seating apparatus includes a portable housing which occupies a third space that is also significantly less than the second space of the use arrangement and larger than the first space of the storage arrangement. A connector attaches the seats to the housing and shifts them between the storage and use arrangements. The connector is pivotally attached to the housing and rotates back and forth relative to the housing to shift the seats between the storage and use arrangements. In the storage arrangement, the space of the housing substantially overlays the space of the storage arrangement.

The connector attaches one of the seats to the top portion of the housing. This seat remains substantially stationary as the connector shifts the seats between the storage and use arrangements. A footrest is connected to the housing by the connector to also shift between the storage and use arrangements. In the storage arrangement, the connector, the seats, as well as any footrests, are substantially within the space of the housing.

The connector may also include a series of synchronized frame systems which are pivotally attached to the inside of the housing. Each frame system includes a plurality of supports and links. The supports include an integrally segmented support having three distinct segments. The links include a common pivotal connection located under at least one of the seats. In operation, each frame system rotates back and forth relative to the housing to shift the seats between the storage and use arrangements. These links pivot to position and maintain the supports in the use arrangement for the seats and pivot to position the seats in the storage arrangement.

The housing includes rollers that allow the housing to be easily moved from one location to another. A shifter is attached to the rollers to switch the rollers between an active state in which the rollers allow movement of the housing and a non-active state in which the rollers do not provide mobility to the housing. Legs may also be attached to the bottom of the housing so that when the shifter switches the rollers to the non-active state, the housing is supported by the legs.

An anti-tipping arm is attached to the housing to prevent the housing from tipping beyond a predetermined amount when the seats are in the use arrangement. As the housing tips the anti-tipping arm engages the ground and the connector to prevent any further tipping beyond the predetermined amount.

BRIEF DESCRIPTION OF THE DRAWINGS

The present invention will be described in connection with the accompanying drawings wherein.

DETAILED DESCRIPTION OF THE PREFERRED EMBODIMENT

Figure 1:
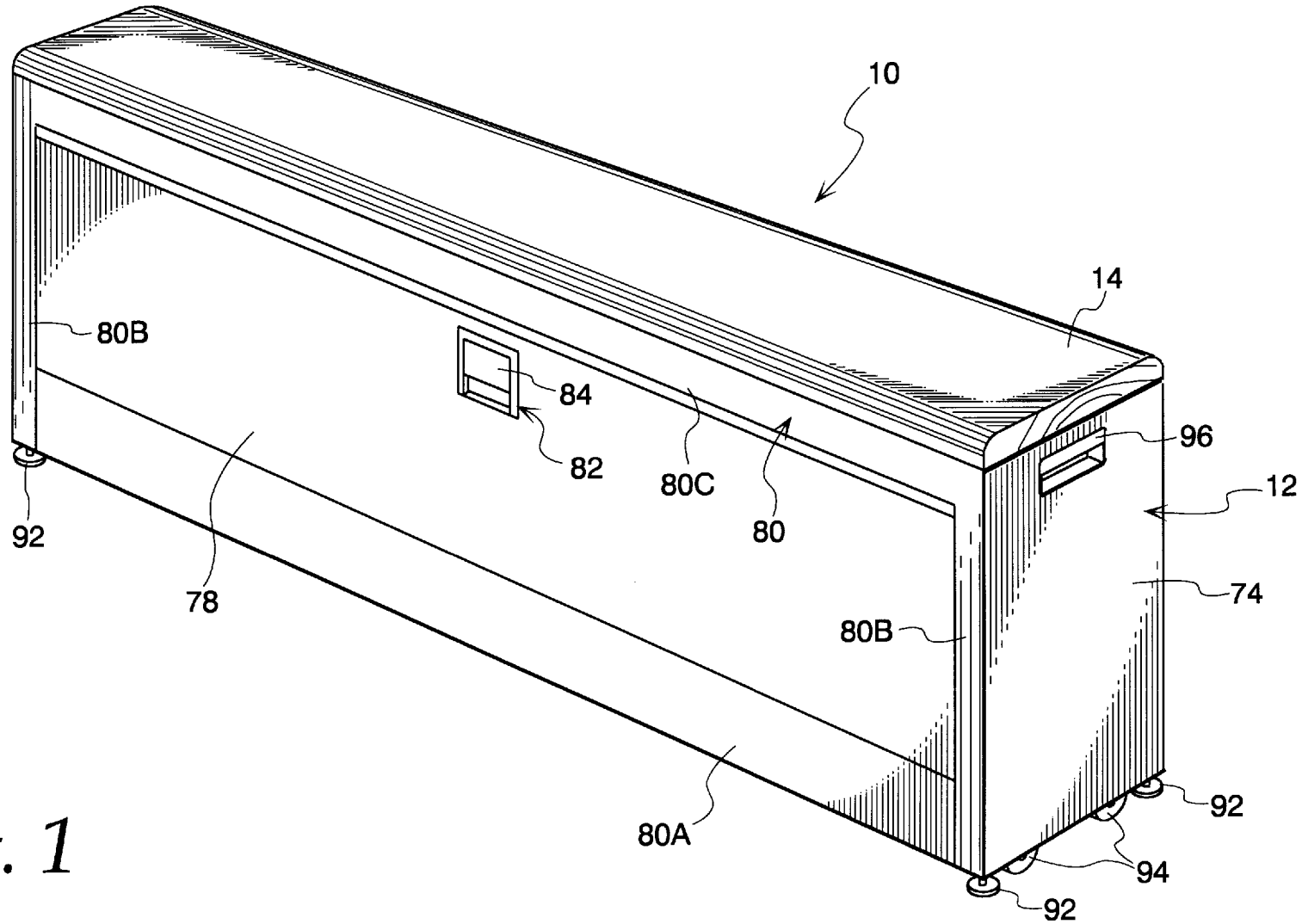
FIG. 1 is a perspective view of a portable seating apparatus embodying features of the present invention and illustrating the storage arrangement.
Figure 2:
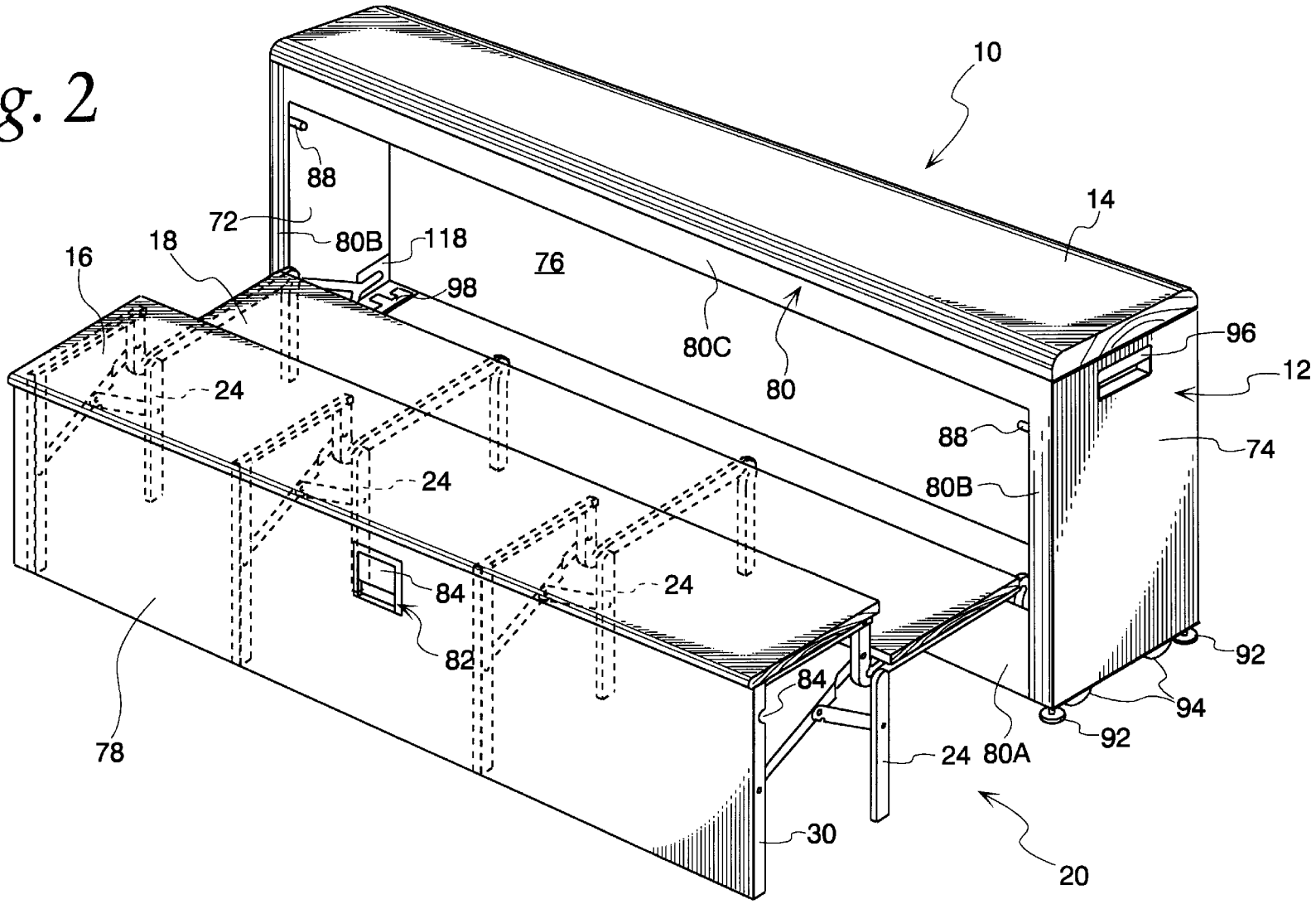
FIG. 2 is a perspective view of the portable seating apparatus of FIG. 1 illustrating the use arrangement.

Referring to FIGS. 1 and 2 of the drawings, there is illustrated one example of the present invention in the form of a portable seating apparatus 10 that is retracted to a housing 12 for a storage arrangement (FIG. 1) and extended from the housing 12 for a use arrangement (FIG. 2). As illustrated in FIG. 2, the seating apparatus 10 includes an upper seat 14, a lower seat 16, a footrest 18, and an understructure system 20. The understructure system 20 supports the lower seat 16 and the footrest 18 in the use arrangement and shifts the seating apparatus 10 between the use and storage arrangements. In the storage arrangement, the lower seat 16, footrest 18 and understructure 20 are located within the housing 12 and substantially underneath the upper seat 14.

As illustrated, the seats 14, 16 and the footrest 18 have an elongated, rectangular, planar configuration. It is desired that the seats 14, 16 be sized large enough to seat multiple spectators comfortably, while also being sized for convenient storage. To operate between the storage arrangement and the use arrangement, the dimensions of the lower seat 16 are to be slightly smaller than those for the upper seat 18. For example, to seat approximately eight average-sized people, the upper bench may be about six feet long, and the lower bench a few inches shorter. The seats 14, 16 and the footrest 18 are made of material that tends to resist deflection, wear, damage and warping.

In order to operate efficiently between the storage and use arrangements, the footrest 18 is also slightly shorter than the upper seat 14 and less wide than both seats 14, 16. While the seating apparatus 10 illustrates only a two tier seating system, the number of tiers may be increased as desired.

Figure 3:
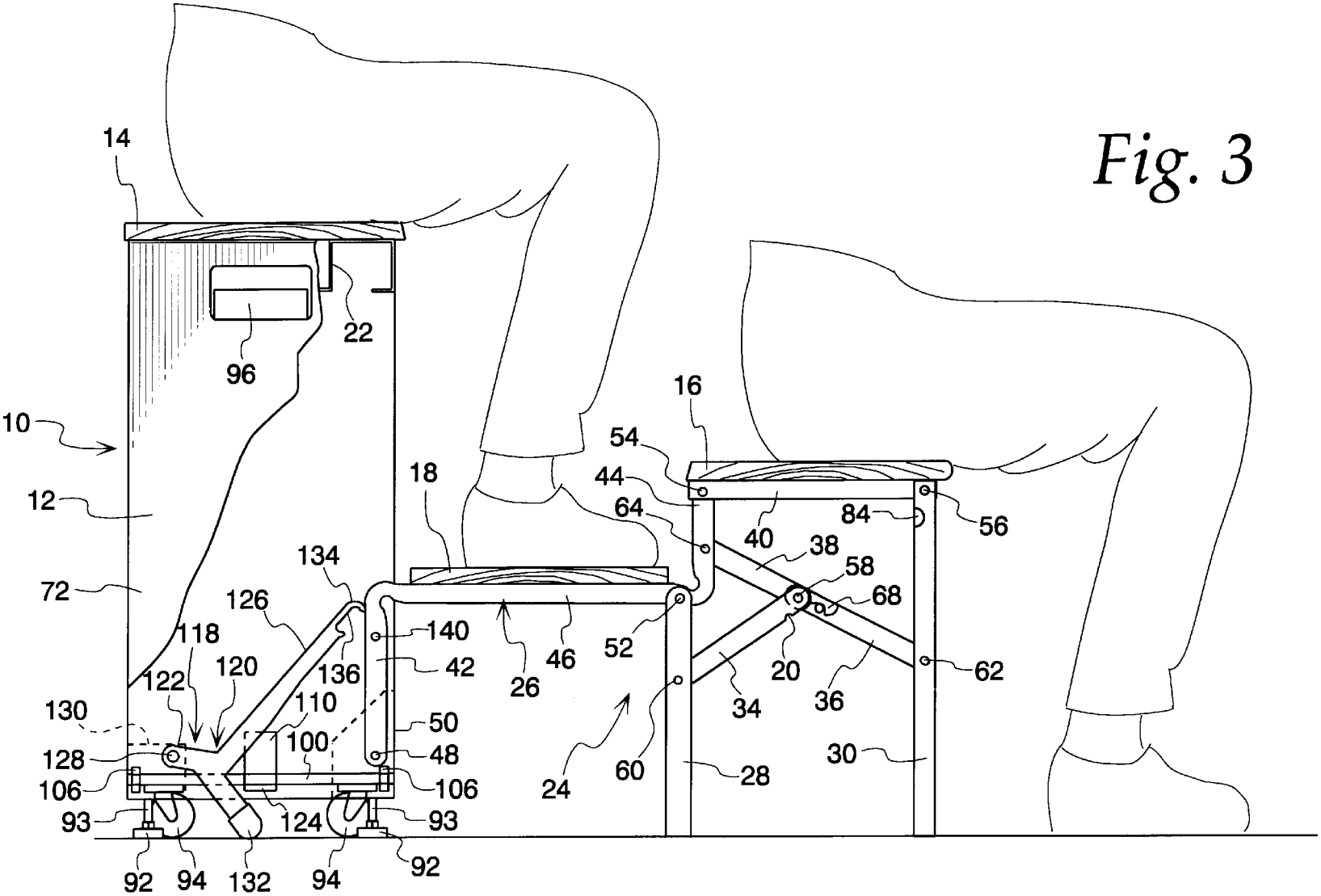
FIG. 3 is a left side, elevational view of the portable seating apparatus of FIG. 1 with the housing partially cut away to illustrate the wheel mechanism and the seats in use arrangement.

With reference to FIGS. 2 and 3, the upper seat 14 is mounted for support directly on top of the housing 12 with any suitable fasteners, such as bolts. The upper seat 14 serves as the top side of the housing 12. To further support the upper seat 14, a beam 22 is attached to the inside of the housing 12 to run longitudinally along underneath the forward portion of the upper seat 14.

The understructure system 20 will now be described with primary reference to the use arrangement for the seating apparatus 10. As illustrated in FIG. 2, the understructure system 20 includes a series of similar frame systems 24 to support the lower seat 16 and footrest 18, as well as operably connecting the lower seat 16 and the footrest 18 to the housing 12. The frame systems 24 are located adjacent the ends of the lower seat 16 and footrest 18 and at locations therebetween to equalize distribution of the load throughout the understructure system 20. The number of frame systems 24 depends generally on the overall length of the seating apparatus 10.

With reference to FIGS. 2 and 3, each frame system 24 includes an array of supports and links pivotally coupled together to cooperate to support the lower seat 16 and the footrest 18 in the use arrangement and to shift the lower seat 16 and the footrest 18 to the storage arrangement. More specifically, each frame system includes a primary support 26, an intermediate upright support 28, an outer upright support 30, a horizontal support 40 and three links 34, 36, 38 coupled at a common pivotal connection 58. The supports and links of each frame system 24 are generally aligned so to operate in substantially the same vertical plane.

Figure 12:
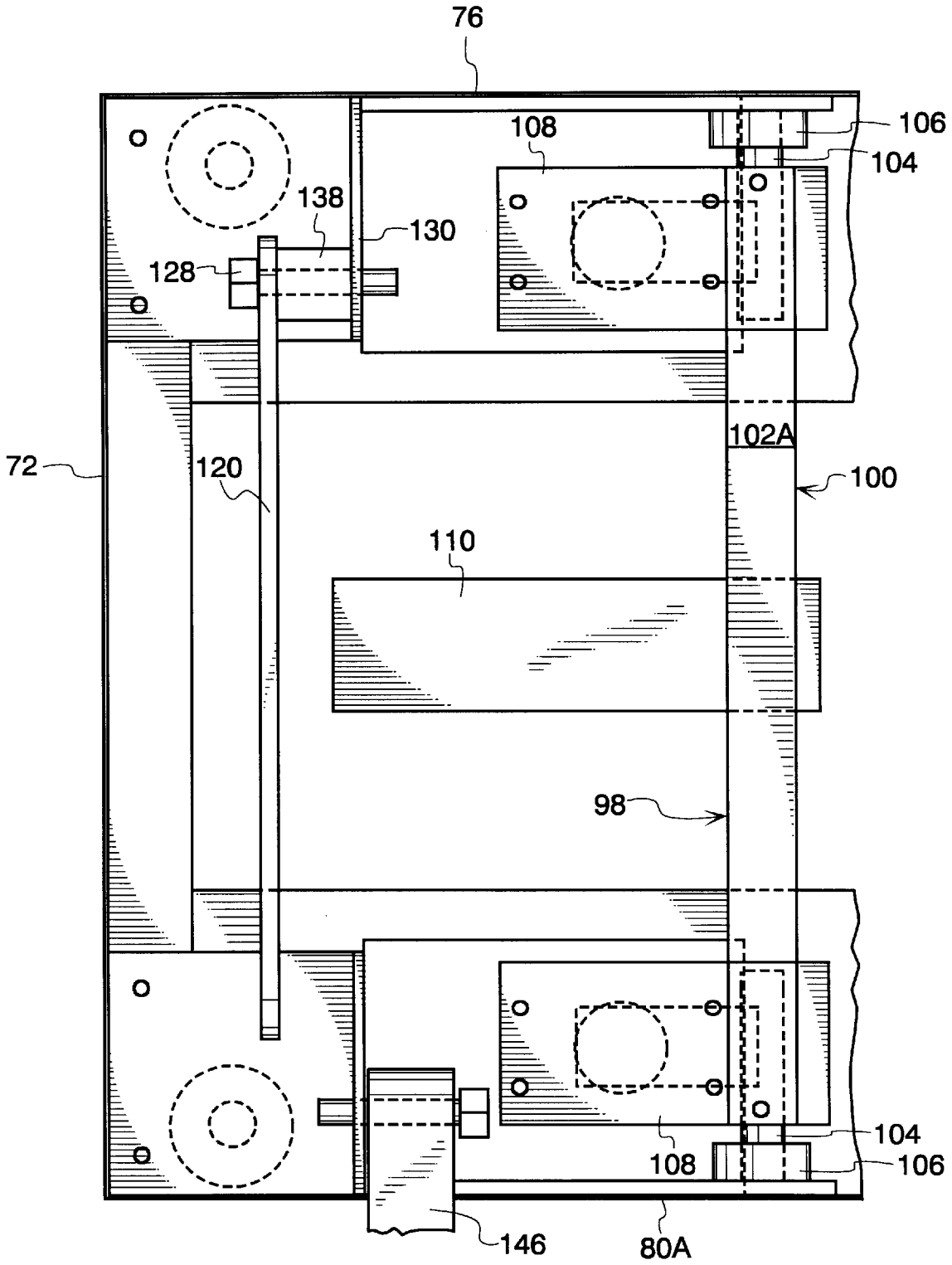
FIG. 12 is an enlarged, fragmentary, top, plan view of the left, inside bottom portion of the portable seating apparatus of FIG. 1 to illustrate the caster lifting mechanism and the anti-tipping mechanism.

More specifically, the primary support 26 is an integral beam having two approximately 90 degree bends to form three segments: two upright segments 42, 44 and an intermediate, horizontal segment 46. The lower end of the first upright segment 42 is attached with a pivotal coupling 48 to a bracket 50 affixed at the front, lower inside portion of the housing 12 (FIG. 12). The horizontal segment 46 extends from the housing 12 and supports the footrest 18. The second upright segment 44 extends upward from the horizontal segment 46 and supports the lower seat 16.

The first upright segment 42 is longer than the second upright segment 44, and the horizontal segment 46 is longer than both upright segments 42, 44. The horizonal segment 46 is slightly longer than the width of the footrest 18. The upright segments 42, 44 are coordinated with the housing 12 and the upright supports 28, 30 to provide the desired seating heights relative to the ground. For example, these desired seating heights may be about 28–30 inches for the upper seat, and about 17–19 inches for the lower seat. Accordingly, the height of the footrest may be, for example, about 11–13 inches.

The upper end of the intermediate upright support 28 is attached with a pivotal coupling 52 to the horizontal segment 46 of the primary support 26 at a location adjacent the bend forming the second upright segment 44. The lower end of the intermediate upright support 28 engages the ground to effectively support the primary support 26 which in turn supports the lower seat 16 and the footrest 18.

The horizontal support 40 has one end attached with a pivotal coupling 54 to the upper end of the second upright segment 44 of the primary support 26. The other end of the horizontal support 40 is attached with another pivotal coupling 56 to the upper end of the outer upright support 30. The lower seat 16 is mounted on the horizontal support 40 with suitable fasteners, such as bolts or screws. The length of the horizontal support 40 is approximately the same as the width of the lower seat 16.

Figure 5:
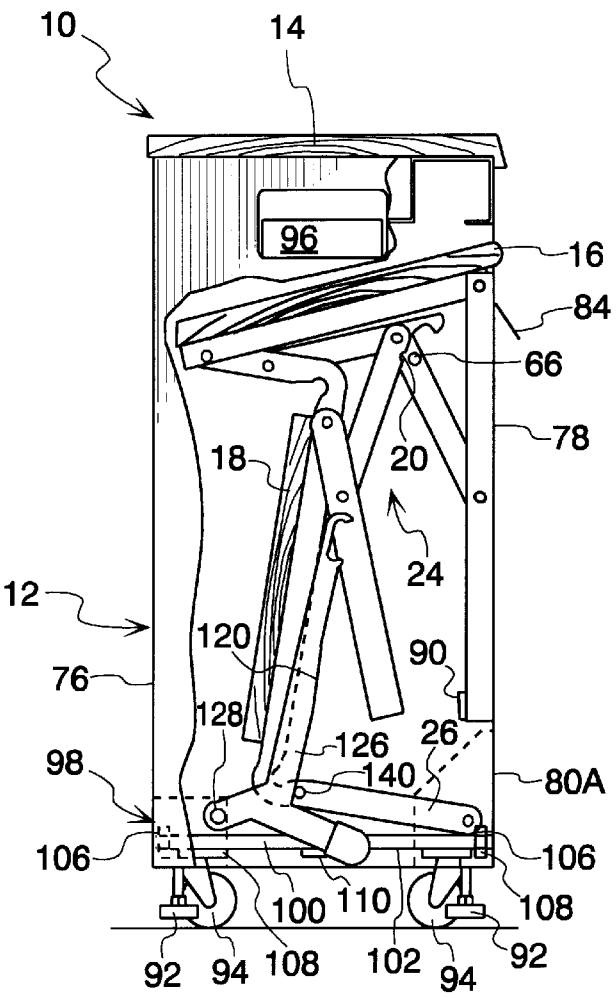
FIG. 5 is a left side, elevational view of the portable seating apparatus of FIG. 1 with the housing partially cut away to illustrate the seats in the storage arrangement.

To provide adequate structural support, the primary support 26 and the outer upright support 30 may have a square cross-section, and the intermediate support 28 and the horizontal support 40 may have a U-shaped cross-section. In the storage arrangement, the primary support 26 and the links are able to pivot and fold inside the support members with U-shaped cross-sections to form a compact storage arrangement, as best illustrated in FIG. 5. The supports may be constructed from any material, such as metal, plastic or wood, that will provide sufficient support for the desired seating capacity.

The links 34, 36, 38 web between the primary support 26, the intermediate upright support 28 and the outer upright support 30. The links 34, 36, 38 are attached together at one end with the common pivotal coupling 58, that is effectively suspended underneath the lower seat 16. The first link 34 has its opposite end attached to the intermediate, upright support 28 with a pivotal coupling 60 at a location intermediate the ends of such support 28. The second link 36 has its opposite end attached to the outer upright support 30 with a pivotal coupling 62 at a location intermediate the ends of the such support 30. The third link 38 has its opposite end attached to the second upright segment 44 of the primary support 26 with a pivotal coupling 64 at a location adjacent the bend forming the such segment 44.

Figure 4:
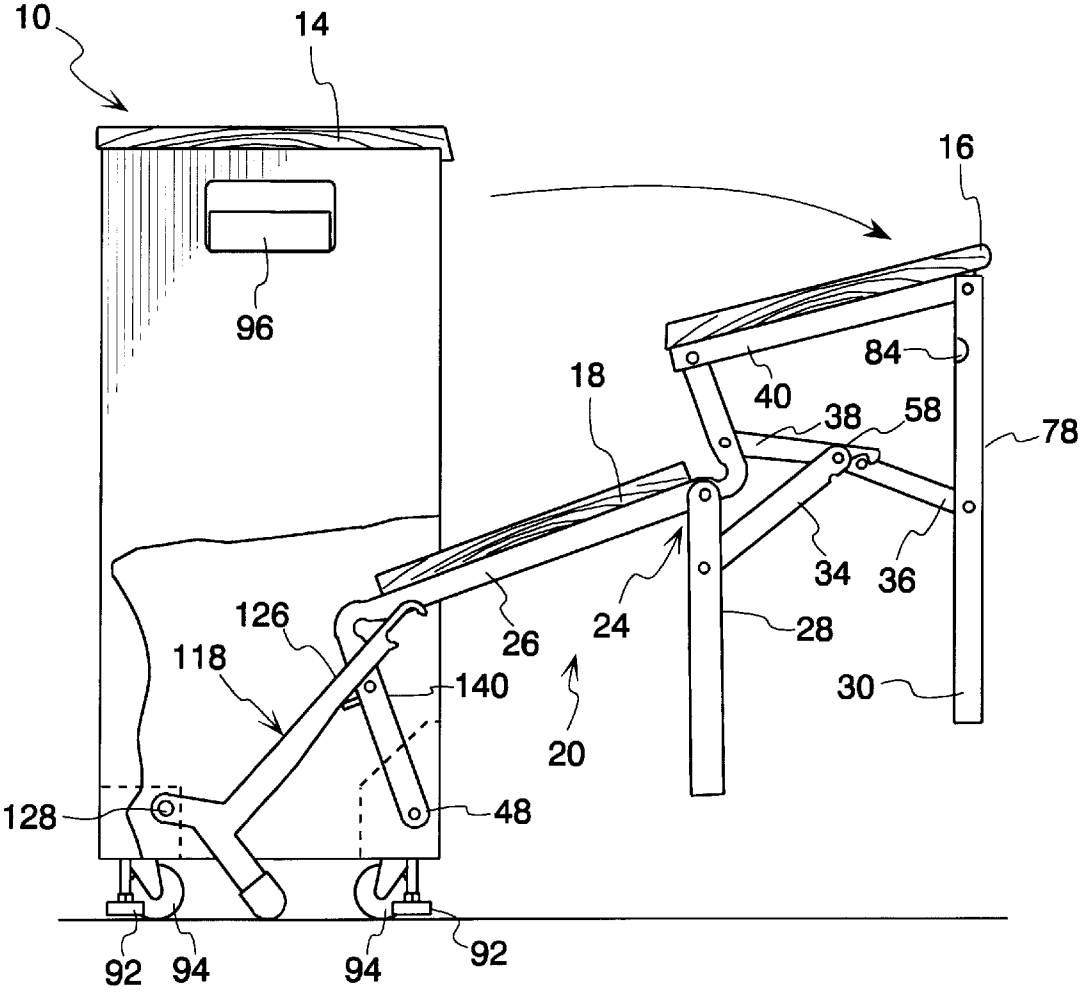
FIG. 4 is a left side, elevational view of the portable seating apparatus of FIG. 1 with the housing partially cut away to illustrate the seats shifting between the storage and use arrangements.

With reference to FIGS. 3–5, each of the frame systems 24 are interconnected traversely by the housing 12, footrest 18 and the lower seat 16 and are synchronized to shift the seating apparatus 10 between the use arrangement (FIG. 3) and the storage arrangement (FIG. 5). In shifting to the use arrangement (FIG. 4), the primary support 26 rotates about its coupling 48 and the links 34, 36, 38 unfold and position the upright supports 28, 30 to support the lower seat 16 and the footrest 18 substantially horizontal. The common coupling 58 shifts down away from the lower seat 16.

After unfolding, the links 34, 36, 38 effectively lock the frame system 24 in the use arrangement. More specifically, adjacent the common coupling 58, the second link 36 includes a pin 66, and the third link 38 includes a notch 68. In the use arrangement, the notch 68 catches on the pin 66 to effectively prevent any further unfolding of the frame system 24.

Similarly, in shifting to the storage arrangement, the links 34, 36, 38 guide the folding of the upright supports 28, 30 to the compact arrangement. The common coupling 58 shifts upward toward the lower seat 16.

After folding, the links 34, 36, 38 prevent any further folding action with a stop. More specifically, the first link 34 includes a notch 70 adjacent the common coupling 58 which catches the pin 66 once the frame system 24 is folded into the housing 12 (FIG. 5). The notch 70 is sized and positioned to allow a range of pivoting among the links 34, 36, 38 necessary to fold the frame system 24 to the storage arrangement inside the housing 12. Each of the links 34, 36, 38 may have a slight bend of differing degree to accommodate attachment at the common coupling 58. Each of the links 34, 36, 38 may be constructed from any suitable material, metal strips, that can control the folding operation and provide sufficient structural support for the desired seating capacity. Each of the foregoing pivotal couplings of the supports and links may be of any suitable, conventional type, such as threaded bolts and nuts.

Referring to FIGS. 1 and 2, the housing 12 takes the shape of a rectangular box defined by the upper seat 14, left end wall 72, right end wall 74, a back wall 76, and a front panel 78 surrounded by a front framing wall 80. The front framing wall 80 includes four portions: a bottom portion 80*a*; side portions 80*b*; and the top portion 80*c*.

The construction of the housing includes, in general, that the bottom portion 80*a* of the framing wall 80 wraps around to the bottom side of the housing 12. Each of the end walls 72, 74 wrap around at their vertical edges to be attached to the back wall 76 and the front framing wall 80. In general, it is desired that the housing 12 be sufficiently sized to house the lower seat 16, the footrest 18 and the understructure 20 in the storage arrangement. For example, for the seating dimensions described previously, the housing may have a length of about 6 feet, a height of about 26–28 inches, and a depth of about 12–14 inches. Further, it is desired that the construction of the housing 12 be sufficiently sturdy to support the upper seat 14 in the use arrangement. The walls and the front panel are to be of a reinforced material, such as plastic, metal or wood, and may be attached together by welding, screws, and nuts and bolts. This material, for example, may be sheet metal of appropriate gauge with a baked enamel painted finish. Any indicia may be painted or printed on the outer surface of the housing walls.

The front panel 78 is attached to the outer upright supports 30 and moves with the understructure system 20 as the seating apparatus 10 shifts between the storage and use arrangements. To maintain the storage arrangement, the panel 78 is secured at its upper portion by a latch mechanism 82, which includes a handle 84 that operates, through a couple of wires or cables (not shown), a pair of latches 86. Each of the latches 86 is located adjacent the upper ends of the side edges of the panel 78. The latches 86 catch the latch pins 88 extending inward from the inner edge of the side framing wall portions 80*b* at a location adjacent the upper ends of such side portions 80*b*.

Since the panel 78 is mounted to the outer upright supports 30, a plurality of L-shaped stops 90 (FIG. 5) are placed along the upper edge of the bottom portion 80*a* of the framing wall 80. The stops 90 prevent the panel 78 from pivoting inward and into the housing 12. Once the panel 78 is locked in the storage arrangement, the lower seat 14, footrest 18 and the understructure 20 are substantially within the housing 12, with the primary exception being that lower seat 14 has a leading edge 81 exposed between the panel 78 and the upper portion 80*c* of the front framing wall 80 (FIGS. 1 and 5). The leading edge 81 is substantially flush with the front framing wall 80 and the panel 78.

Referring to FIGS. 1, 3–5 and 11, the housing 12 includes four foot pads 92, one being attached to a mounting bracket 95 at each bottom corner. Each foot pad 92 is permanently secured with a suitable fastener, such as a bolt, which extends down to elevate the housing 12. The foot pads 92 limit movement of the housing 12 in the use arrangement for the seating.

In the storage arrangement, four caster assemblies 94, one being located adjacent each of the foot pads 92, supports the housing 12 for easily transporting the seating apparatus 10 from one location to another. The seating apparatus 10 is easily moved by pushing (FIG. 11) or pulling the housing 12. The housing 12 also includes a recessed handle 96 in each of the end walls 72, 74, which can be gripped to pull and guide the seating apparatus 10 during transport.

Adjacent each of its end walls 72, 74, the housing 12 includes a caster lifting mechanism 98. There is one lifting mechanism 98 for each pair of the caster assemblies 94 located adjacent the end walls 72, 74. As the seating apparatus 10 shifts between the storage and use arrangements, the frame systems 24 located adjacent the end walls 72, 74 actuate the similarly located lifting mechanism 98 to raise and lower the housing 12 between being supported by the caster assemblies 94 and the foot pads 92, respectively.

Referring to FIGS. 5, 7–10 and 12, and with primary reference to the left end of the seating apparatus 10, each caster lifting mechanism 98 includes a shaft 100 extending perpendicularly between the back wall 76 and the front framing wall, lower portion 80*a*. The shaft 100 has a square outer surface 102 with a top side 102*a*, a bottom side 102*b*, a left side 102*c* and a right side 102*d*. The ends 104 of the shaft 100 are rounded and are each mounted into a bearing or bushing 106, one bushing 106 being attached to the back wall 76 and the other to the front framing wall, lower portion 80*a*. The shaft may also have a hexagonal or round cross-section adapted accordingly.

The shaft 100 includes a pair of caster mounting plates 108, one being attached to the bottom side 102*b* adjacent each end 104 of the shaft 100. Each plate 108 extends toward the housing end wall adjacent the lifting mechanism 98 (e.g., end wall 72). The caster assemblies 94 are attached to the bottom side of the mounting plates 108 using any conventional fastener, such as a nut and bolt.

An actuator plate 110, which acts as a lever to rotate the shaft 100 to raise and lower the housing about the caster assemblies 94, is attached to the bottom side 102*b* of the shaft 100 at a location approximately equidistant from the shaft ends 104. The actuator plate 110 extends in the same plane as the caster mounting plates 108 and toward the adjacent end wall (e.g., end wall 72) in order to traverse the plane in which the adjacent frame system 24 operates. The shaft 100, caster mounting plates 108 and actuator plate 110 may be made from any conventional material, such as metal, which is rigid and sturdy enough to support the housing 12 and resist deflection and wear. These plates 108, 110 may be welded to the shaft 100.

The caster lifting mechanism 98 includes a pair of stops 112*a*, 112*b* to limit rotation of the shaft 100. For example, the outer stop 112*a* limits rotation to that necessary to raise the housing 12 sufficiently off the foot pads 92 to enable easy rolling on the caster assemblies 94 (storage arrangement), and the inner stop 112*b* limits rotation to that necessary to allow the housing 12 to rest on the foot pads 92 (use arrangement). The shaft 100 includes a locator pin 114 extending upward from the top side 102*a* between the stops 112*a*, 112*b*. Thus, the stops 112*a*, 112*b* limit the rotation of the shaft 100 by engagement with locator pin 114. The stops and locator pin may be threaded bolts threaded into threaded bores in the back wall (or a mounting plate affixed to the back ball) and the shaft, respectively. Further, the rotational range of the shaft between the storage arrangement and the use arrangement may be in the approximate range of 10–15 degrees.

As the seating apparatus 10 shifts from the use arrangement to the storage arrangement, a significant amount of the weight of the lower seat 16, footrest 18 and understructure system 20 is applied to the actuator plates 110 of the caster lifting mechanisms 98. Each of the primary supports 26 of the frame systems 24 adjacent the ends walls 72, 74 of the housing 12 engages the actuator plates 110 to rotate the shaft 100 and the caster assemblies 94 (e.g., counter-clockwise with reference to the lifting mechanism 98 adjacent the left end wall 72) to raise the housing 12 off the foot pads 92.

More specifically, each of the primary supports 26 of the frame systems 24 adjacent the end walls 72, 74 include a finger 116, which extends from the back side of the first upright segment 42 at a location adjacent the bend forming the horizontal segment 46. The finger 116 is calibrated to have sufficient length to move the actuator plates 110 to lower the caster assemblies 94 which effectively raise the housing 12 upon the caster assemblies 94. When the housing 12 is raised on the caster assemblies 94, the frame system 24 is folded to the storage arrangement and the actuator plate 110 is substantially parallel with the ground. Once the front panel 78 is secured with the latch mechanism 82, the caster assemblies 94 are locked in this arrangement. The fingers 116 may be made from any material sufficiently rigid to transfer weight from the lower bench 16, the footrest 18 and the understructure 20 to the caster lifting assembly 98. For example, the finger 116 may be a metal bolt turned into a hole or threaded bore in the upright support segments 42.

As the seating apparatus 10 shifts from the storage to the use arrangement, the finger 116 is removed from the actuator plate 110 (e.g., as indicated by an arrow with reference number 115 (FIGS. 8 and 10)). Accordingly, the weight of the lower seat 16, footrest 18 and understructure 20 is removed from the caster lifting mechanisms 98. As a result, the ground urges the caster assemblies 94 (e.g., as indicated by an arrow having reference number 129) to rotate the shaft 104 (e.g., clockwise as indicated by an arrow having reference number 131) so that the casters assemblies 94 are simply resting on the ground under gravity, and the housing 12 is lowered onto foot pads 92 (e.g., as indicated by an arrow with reference number 127).

With reference to FIGS. 2, 3, 6, 9, 10 and 12, the seating apparatus 10 includes a pair of anti-tipping mechanisms 118 to limit tipping of the housing 12 while in the use arrangement for the seats. Each anti-tipping mechanism 118 is situated between one of the end walls 72, 74 and the frame system 24 at the ends of the understructure 20.

Since each anti-tipping mechanism 118 is the mirror image of the other, the following will be with primary reference to only the anti-tipping mechanism 118 situated at the left end of the housing 12. The anti-tipping mechanism includes a multi-arm lever 120 having a pivot arm 122, a ground arm 124 and a stop arm 126. Both the pivot arm 122 and the ground arm 124 are disposed at predetermined angles relative to the stop arm 126. These angles depend on the overall size of the seating apparatus and its constituent components. In the preferred embodiment, the angle between the pivot arm 122 and the stop arm 126 is in the approximate range of 1.1 to 1.5 times greater than the angle between the ground arm 124 and stop arm 126.

The pivot arm 122 is attached with a pivotal attachment 128 to a bracket 130 affixed in the housing 12 at the lower, rear corner. At the pivotal attachment 128, a spacer 138 is situated between the pivot arm 122 and the bracket 130 to space the vertical plane of operation for the lever 120 clear of the actuator plate 110 of the caster lifting mechanism 98 (FIG. 12). The free end of the ground arm 124 is fitted with a shoe 132, which is adapted to protect the ground surface. An intermediate segment of the stop arm 126 tapers slightly in width at a predetermine rate toward its free end 134. A C-shaped hook 136 is formed by the free end 134 of the stop arm 126.

As illustrated best in FIG. 3, when the seating apparatus 10 is in the use arrangement, the lever 120 is situated so that the shoe 132 of the ground arm 124 engages the ground under gravity and the hook 136 of the stop arm 126 hovers in the proximity of an anti-tipping pin 140. The anti-tipping pin 140 extends outward from the primary support 26 of the frame system 24 adjacent the finger 116 for the caster lifting mechanism 98. More specifically, the pin 140 extends from the first upright segment at a location immediately above the finger 116 and substantially perpendicular to the adjacent end wall 72.

Figure 6:
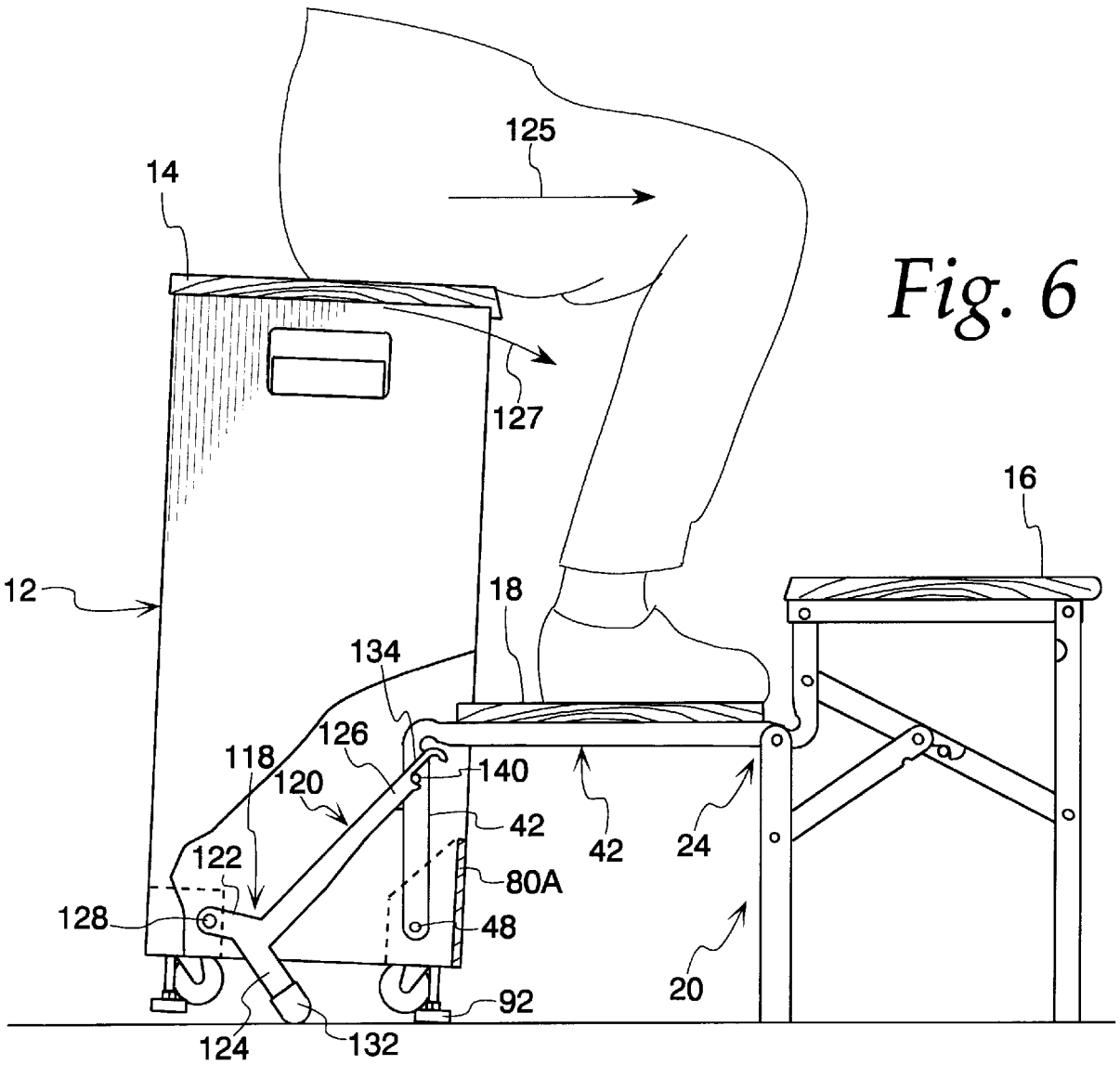
FIG. 6 is a left side, elevational view of the portable seating apparatus of FIG. 1 with the housing partially cut away to illustrate the anti-tipping mechanism.
Figure 8:
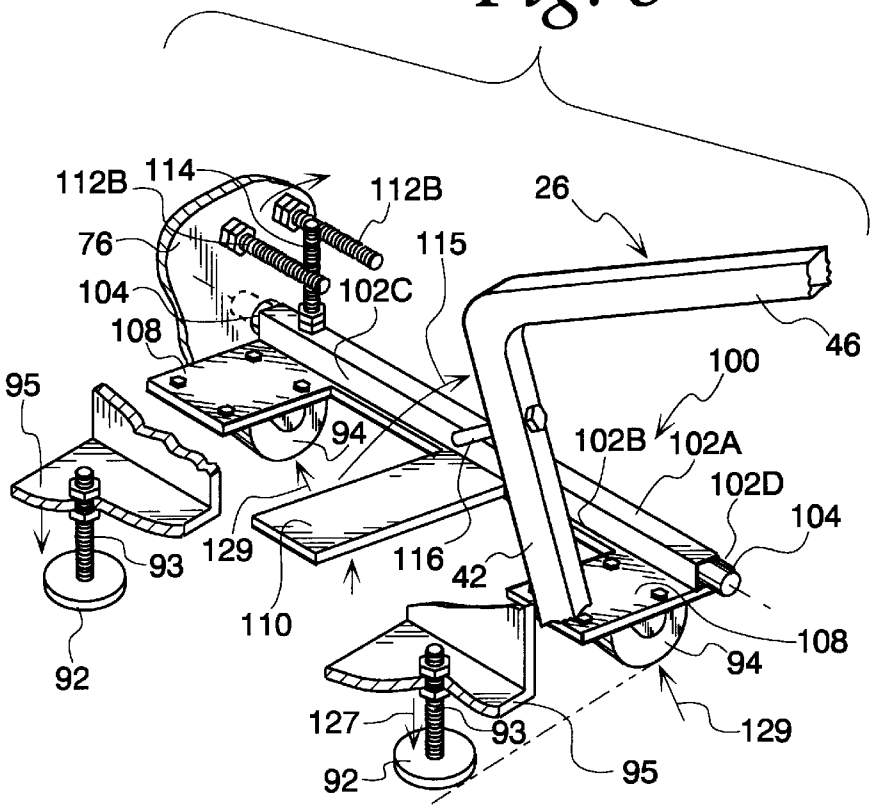
FIG. 8 is an enlarged, fragmentary, perspective view of the caster lifting mechanism of the portable seating apparatus of FIG. 1 in the use arrangement for seats.
Figure 7:
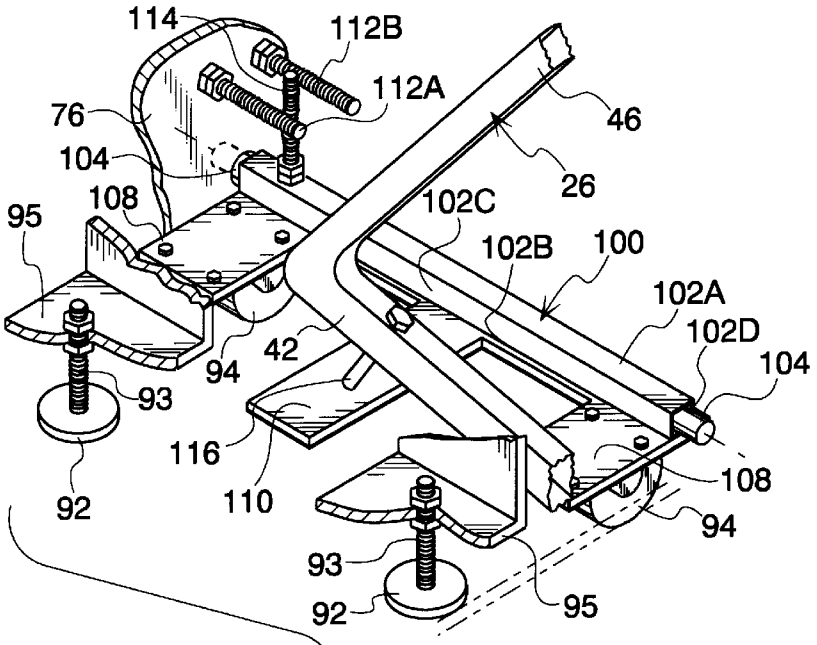
FIG. 7 is an enlarged, fragmentary, perspective view of the caster lifting mechanism of the portable seating apparatus of FIG. 1 in the storage arrangement for the seats.
Figure 11:
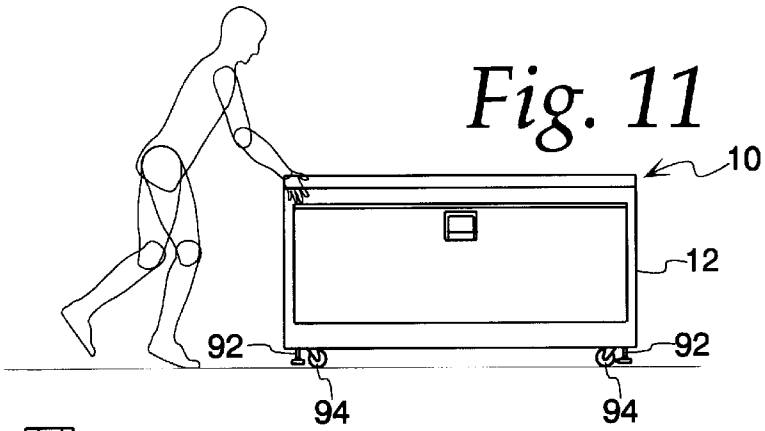
FIG. 11 is a front elevational view of the portable seating apparatus of FIG. 1 to illustrate the portability of the present invention.
Figure 10:
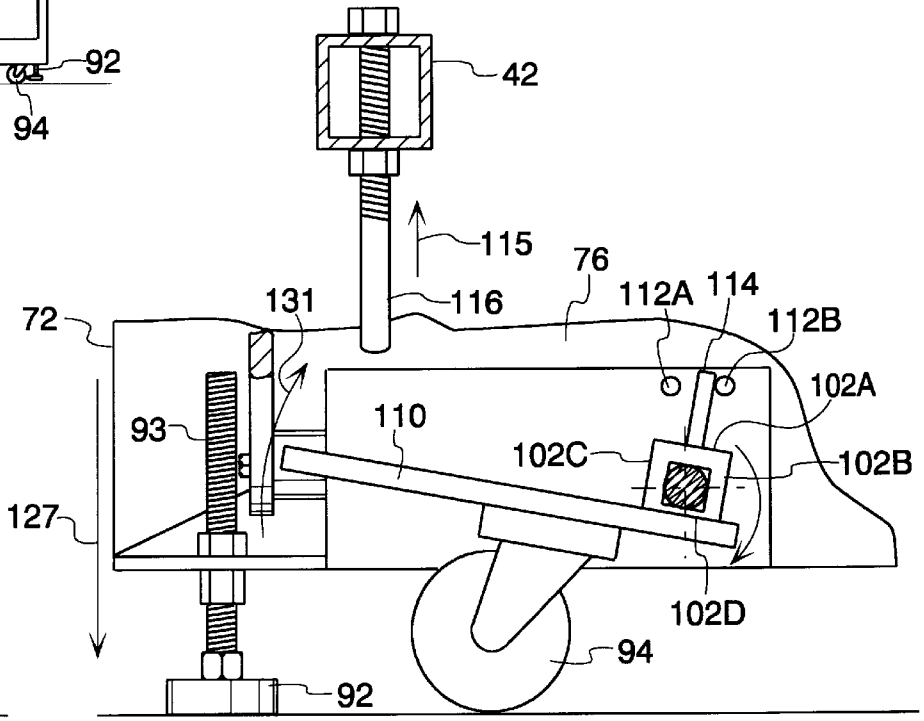
FIG. 10 is a cross-sectional view of the caster lifting mechanism and the anti-tipping mechanism of the portable seating apparatus of FIG. 1 in the use arrangement for the seats.
Figure 9:
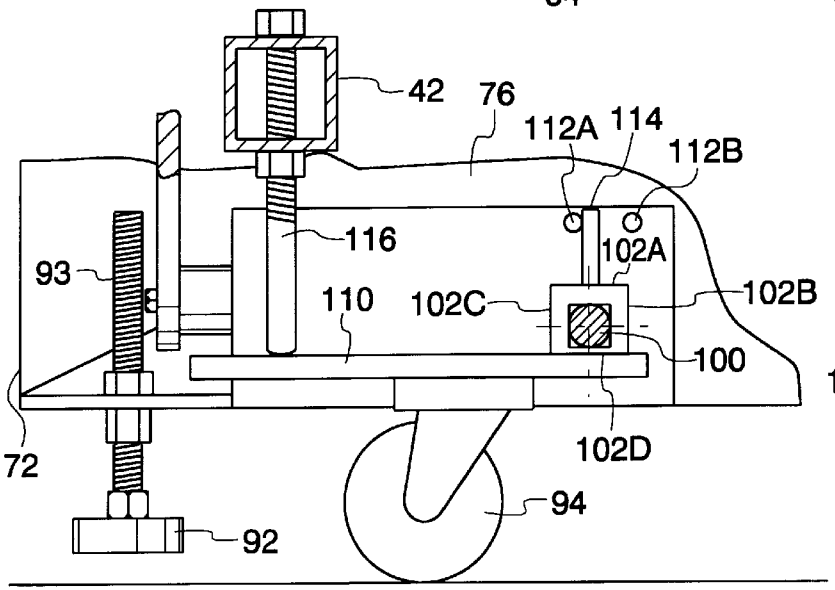
FIG. 9 is a cross-sectional view of the caster lifting mechanism and the anti-tipping mechanism of the portable seating apparatus of FIG. 1 in the storage arrangement for the seats.

As illustrated best in FIG. 6, when a spectator slides forward on the upper seat 14 (e.g., as indicated by an arrow having reference number 125), the housing 12 tips forward about the pair of front foot pads 92 (e.g., as indicated by an arrow having reference number 127). As the housing 12 tips forward, sliding the ground arm 124 on the ground, the lever 120 rotates forward, due to the pivotal coupling 128 with the rear portion of the housing, and the back portion of the hook 136 of the stop arm 126 engages the anti-tipping pin 140 to prevent any further tipping of the housing 12 toward the lower seat 16. The anti-tipping pin 140 remains substantially stationary during any tipping of the housing 12 due to the pivotal attachment 48 of the primary support 42 and the weight of the lower seat 16, foot rest 18, understructure system 20 and any spectators seated thereon. Backward tipping of the housing 12 is limited by the lower portion 80*a* of the front framing wall 80 abutting against the first upright segments 42 of the primary supports 42 of the frame systems 24.

As illustrated best in FIGS. 4 and 5, as the seating apparatus 10 shifts to the storage arrangement, the anti-tipping mechanism 118 operates to retract the ground arm 124 into the housing 12. That is, the anti-tipping pin 140 cams along the stop arm 126 to rotate the lever 120 about the pivotal attachment 128 to rotate the ground arm 124 into the housing. The tapering width of the stop arm 126 ensures that the lever 120 rotates sufficiently to bring the ground arm 124 into the housing 12 when shifting to the storage arrangement and to allow the stop arm 126 to clear the pin 140 when in a non-activated use arrangement (FIG. 3). Once the front panel 78 is secured with the latch mechanism 82, the anti-tipping mechanisms 118 are locked in this storage arrangement in the housing 12 and will not interfere with the operation of the caster assemblies 94.

It will be understood that various changes in the detail, materials and arrangement of parts and assemblies which have been herein described and illustrated in order to explain the nature of the present invention may be made by those skilled in the art within the principle and scope of the present invention as expressed in the appended claims.

What is claimed is:

1. A portable seating apparatus comprising:

a plurality of seats having a storage arrangement and a use arrangement, the storage arrangement occupying a first space and the use arrangement occupying a second space, the first space being less than the second space;

a portable housing enclosing at least one of the plurality of seats, the portable housing defining in part a third space, the third space being greater than the first space and less than the second space, the plurality of seats being attached to the portable housing; and a plurality of connectors attaching the seats to the portable housing, the connectors being operable to shift at least one of the seats between the storage arrangement and the use arrangement, the connectors occupying the first space when the seats are in the storage arrangement and occupying the second space when the seats are in the use arrangement, the connectors being independent of the third space defined by the portable housing such that the third space is greater than the first space of the storage arrangement and extends beyond the connectors when the seats are in the storage arrangement.

2. A portable seating apparatus in accordance with claim 1 wherein each of the connectors includes a pivotal attachment to the portable housing, the connectors rotate about the pivotal attachments to shift the seats between the storage arrangement and the use arrangement.

3. A portable seating apparatus in accordance with claim 2 wherein the connectors rotate about the pivotal attachments to substantially inlay the first space of the storage arrangement within the third space of the housing, the third space of the housing being defined substantially independent of the first space such that the connectors are within the third space and the housing.

4. A seating apparatus comprising:

a plurality of seats having a storage arrangement and a use arrangement, the storage arrangement occupying a first space and the use arrangement occupying a second space, the first space being less than the second space;

a housing occupying a third space, the third space being greater than the first space and less than the second space; and a plurality of connectors attaching the seats to the housing, the connectors being operable to shift the plurality of seats between the storage arrangement and the use arrangement, at least one of the connectors includes a pivotal attachment to the housing and rotates about the pivotal attachment to shift the seats between the storage arrangement and the use arrangement and to substantially overlay the third space of the housing with the first space of the storage arrangement and at least one of the connectors attaches at least one of the seats to the housing to be substantially stationary relative to the housing as the connectors shift the seats between the storage arrangement and the use arrangement and in the storage arrangement the remaining seats are located substantially within the housing substantially under the substantially stationary seat.

5. A seating apparatus in accordance with claim 4 further comprising a footrest attached to the housing with the connector for use with the substantially stationary seat.

6. A portable seating apparatus in accordance with claim 1 further comprising rollers attached to the portable housing to move the portable housing from one location to another when the seats are in the storage arrangement.

7. A portable seating apparatus in accordance with claim 6 further comprising a shifter attached to the rollers, the shifter rotating the rollers between an active state in which the rollers support the portable housing for movement and a non-active state in which the rollers do not support the portable housing for movement.

8. A portable seating apparatus in accordance with claim 7 further comprising a plurality of legs attached to the portable housing to support the portable housing and limit movement of the portable housing when the seats are in the use arrangement.

9. A portable seating apparatus in accordance with claim 8 wherein the rollers are automatically extended beyond the legs for the active state as the seats are shifted to the storage arrangement to support the portable housing and are automatically retracted as the seats are shifted to the use arrangement such that the legs extend beyond the rollers for the inactive state to support the portable housing in the use arrangement.

10. A portable seating apparatus in accordance with claim 7 wherein at least one of the connectors actuates the shifter to automatically rotate the rollers to the active state as the seats are shifted to the storage arrangement and to automatically rotate the rollers to the non-active state as the seats are shifted to the use arrangement.

11. A portable seating apparatus in accordance with claim 1 further comprising an anti-tipping arm attached to the portable housing for rotation to automatically limit tipping of the portable housing when the seats are in the use arrangement.

12. A seating apparatus comprising:

a housing having a plurality of upstanding wall portions;

a first seat attached to the housing;

a second seat being spaced from the first seat; and an understructure system attaching the second seat to the housing, the understructure system being operable to shift the second seat between a use arrangement in which the second seat is spaced from the first seat a first distance and a storage arrangement in which the second seat is spaced from the first seat a second distance, the first distance being greater than the second distance and in the storage position the upstanding wall portions generally surrounding at least a portion of the understructure system.

13. A seating apparatus in accordance with claim 12 wherein the understructure includes a series of frame structures, each frame structure being pivotally attached to the housing and includes a plurality of supports and links to support the second seat in the use arrangement and to rotate the second seat to the storage arrangement, in the storage arrangement the second seat being substantially within the housing and substantially under the first seat.

14. A seating apparatus in accordance with claim 13 wherein the plurality of supports includes at least three supports, the links being pivotally attached to at least three of the supports, the links being spaced to position and maintain the plurality of supports in the use arrangement for the seats and being pivotable to shift to the storage arrangement for the seats.

15. A seating apparatus in accordance with claim 14 further comprising:

a plurality of rollers attached to the housing at a location opposite the first seat for supporting the housing when the seats are in the storage arrangement;

a plurality of legs attached to the housing, each leg being attached at a location adjacent one of the rollers for supporting the housing when the seats are in the use arrangement; and a shifter attached to the rollers, the shifter rotating as the second seat is shifted between the storage and use arrangements to switch the housing between the rollers for support and the legs for support.

16. A seating apparatus in accordance with claim 15 wherein the understructure system includes an actuator to automatically actuate the shifter to rotate to switch the housing to the rollers for support as the seats are rotated to the storage arrangement and to switch the housing to the legs for support as the seats are rotated to the use arrangement.

17. A seating apparatus in accordance with claim 12 further comprising an anti-tipping arm being pivotally attached to the housing, the anti-tipping arm cooperating with the understructure system to limit tipping of the housing when the seats are in the use arrangement, the anti-tipping mechanism rotating with the understructure system as the seats are shifted between the storage arrangement and the use arrangement.

18. A seating apparatus comprising:

a first seat;

a second seat spaced from the first seat;

an understructure interconnecting and supporting the first seat and the second seat, the understructure having a series of synchronized pivoting frame systems to shift the seats between a use arrangement in which the second seat is spaced from the first seat a first distance and a storage arrangement in which the second seat is spaced from the first seat a second distance, the first distance being greater than the second distance; and each frame system having a plurality of supports and links, the supports including at least one integrally segmented support, the segmented support having a first segment pivotally attaching the frame system to the understructure, a second segment supporting the second seat and a third segment interconnecting the first and second segment, the first and second segments extending in different directions than the third segment, the links having a common pivotal connection, the common pivot connection being located under the second seat in both the use and storage arrangements for the seats.

19. A seating apparatus in accordance with claim 18 wherein each link has spaced ends, one end of each link being pivotally attached to the other links at the common pivotal connection, and the other end being pivotally connected to one of the supports.

20. A seating apparatus in accordance with claim 19 wherein the links have a stop adjacent the common pivotal connection to limit pivoting at the common pivotal connection.

* * * * *